United States Patent [19]

Fisher

[11] 4,260,47

[45] Apr. 7, 198

[54] INSOLUBLE ANODE FOR ELECTROWINNING METALS

[75] Inventor: Gordon L. Fisher, Mahwah, N.J.

[73] Assignee: The International Nickel Company, Inc., New York, N.Y.

[21] Appl. No.: 89,208

[22] Filed: Oct. 29, 1979

[51] Int. Cl.[3] ..... C25B 11/02; C25B 11/04

[52] U.S. Cl. ..... 204/286; 204/290 F

[58] Field of Search ..... 204/286, 290 F

[56] References Cited

U.S. PATENT DOCUMENTS

| | | | |
|---|---|---|---|
| 3,915,837 | 10/1975 | Feige | 204/286 |
| 3,947,344 | 3/1976 | Golikov et al. | 204/286 |
| 3,981,790 | 9/1976 | Olson et al. | 204/286 |
| 4,064,031 | 12/1977 | Kamarian | 204/256 |
| 4,139,448 | 2/1979 | Wallace | 204/2 |

FOREIGN PATENT DOCUMENTS 2009491 6/1979 United Kingdom .

*Primary Examiner*—F. C. Edmundson

*Attorney, Agent, or Firm*—R. J. Kenny; F. J. Mulliga Jr.

[57] ABSTRACT

An essentially planar electrowinning anode made infiltrated sintered metal, e.g. lead infiltrated sinter titanium having longitudinally extending bars of le metallurgically bonded to and shielded by the infiltrat metal. Advantageously the anode is made up of at lea two strips of lead infiltrated, sintered titanium with lead bar bridging the junction of the strips.

5 Claims, 5 Drawing Figures

INSOLUBLE ANODE FOR ELECTROWINNING METALS

The present invention is concerned with an essentially planar anode and, more particularly, is concerned with an essentially planar anode made of sintered anodically passivatable metal infiltrated with a metal capable of anodically forming an electroconductive oxide.

HISTORY OF THE PRIOR ART AND PROBLEM

Composite anodes of the kind in question, particularly anodes made of sintered titanium infiltrated with lead or lead alloys are disclosed in U.S. patent application Ser. No. 850,290 filed Nov. 10, 1977 in the names of Turillon, Nordblom and Hull, the disclosures of which application are incorporated herein by reference. Similar disclosures also incorporated herein by reference, somewhat abbreviated, are found in corresponding U.K. Pat. No. 2,009,491A of June 13, 1979. These prior art disclosures related to electrode structures, particularly anodes, which are made by grinding titanium sponge to powder, forming this powder to a compact having about 20% to about 50% porosity and sintering the compact under a protective atmosphere to provide a mechanically strong, porous matrix. This matrix is then infiltrated with molten lead or lead alloy under a protective atmosphere until at least the exterior portion of the pores of the matrix are filled with infiltrated metal. The infiltrated metal is then anodically oxidized to an electroconductive oxide, eg., lead dioxide insoluble in the electrolyte in which the anode is used. While the physical and mechanical characteristics of lead-infiltrated sintered titanium are excellent, particularly when the sintered titanium, prior to infiltration, is about 50% to about 80% of theoretical titanium density, the product is somewhat limited in electrical conductivity. In additiion infiltrated sintered metal may be practically limited in dimension by the method of manufacture. For example, using roll compaction, porous, sintered titanium of essentially uniform quality can be made in strips up to about 40cm wide. Much beyond this width, it becomes difficult to maintain uniform porosity across the strip. Thus the infiltrated product produced from too wide strip will vary in amount of contained infiltrated metal across the width of the strip.

Commercial anodes such as used in the electrowinning of zinc are usually at least about 55 cm wide and up to 100 cm or more long. With conventional zinc electrowinning anode materials such as argentiferous lead, the material can be readily cast to anode size as a slab perhaps 0.8 cm thick or thicker. In order to use the composite infiltrated, sintered metal as full scale zinc electrowinning anodes it is necessary for the available strips to be joined. Further, if infiltrated sintered metal is available in the required widths for full scale anode, it is still useful to provide internal, longitudinally extending conductors in infiltrated sintered metal anodes adapted to carry currents sufficient to provide anode current densities of about 3 to about 10 amps/dm$^2$.

THE INVENTION

According to the invention, full scale anodes, particularly electrowinning anodes for zinc and other metals comprise a plurality of strips of infiltrated sintered metal in an essentially co-planar parallel array. Each of said strips are metallurgically bonded to at least one bar of metal extending the length of said strips. The metal of said bar is one which is capable of anodically formin protective oxide coating in the electrolyte in which s anode is used and which has an electrical conductiv superior to the infiltrated sintered metal. The bars h a total cross-sectional area adequate for efficient p sage of electric current the length of said anode: e one of said bars is laterally sheathed in the infiltrat sintered metal of adjacent strips and the bars prov means for contact with means for feeding electric c rent to the anode. Even more broadly, the anodes of present invention include structures having surfaces infiltrated sintered metal with current carrying me bars contained therein. The full scale electrowinn anodes are usually made from infiltrated, sintered me (ISM) by forming on one face, near a side edge, of a ISM strip a depression or groove extending a length the strip equal to the length of the full scale electrow ning anode; overlapping the depression with a flat p tion adjacent an edge of another strip of ISM of eq length; metallurgically bonding metal of both strips the site of the depression or groove to metal which anodically oxidizable to form a protective oxide coat in the electrolyte in which the anode is used, and; peating the process stepwise with additional strips u a width sufficient for a full scale anode is achieved. T process provides an essentially planar anode structu comprising a plurality of ISM strips, each pair of sti joined by an ISM metal connector, the connector a the strip sheathing the sides at least one rod-like, lon tudinally extending, mass of metal adhered to the in trated surface of both overlapping parts, said rod-l mass of metal comprising a conducting member in s anode and providing means for making electri contact with said anode.

OBJECTS OF THE INVENTION AND BRIEF DESCRIPTION OF THE DRAWINGS

It is an object of the present invention to provid process for joining strip-form, infiltrated sintered me Another object of the present invention is to prov a novelly joined full scale electrowinning anode ma of infiltrated sintered metal.

Other objects and advantages will become appar from the following description taken in conjuncti with the drawing in which.

DETAILED DESCRIPTION OF THE INVENTION

Figure 1:
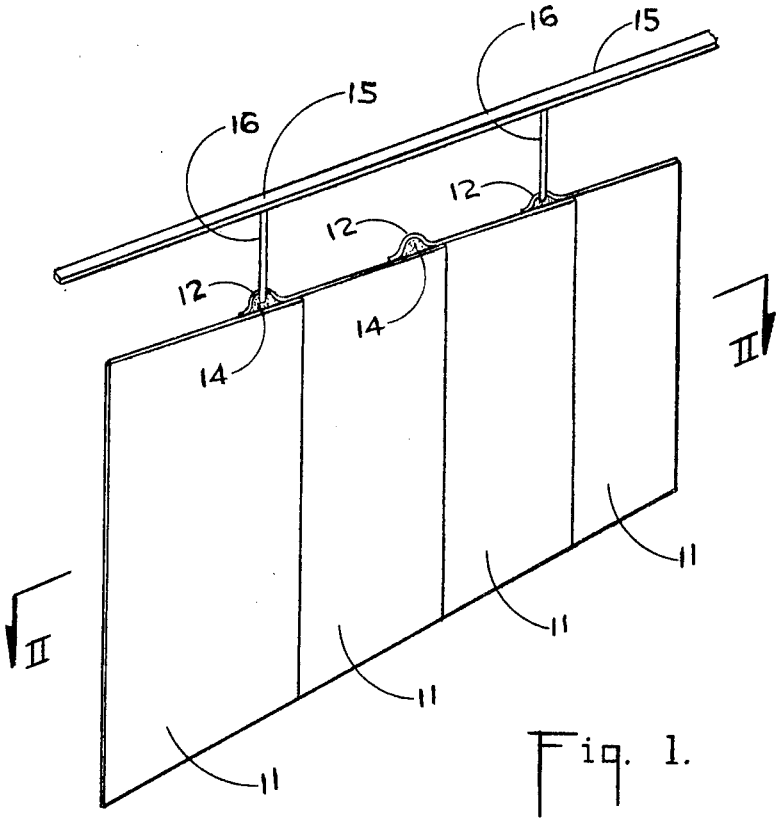
FIG. 1 is a perspective view of an anode of the pr ent invention.

Anodes of the present invention are depicted in drawing. Referring thereto and, particularly to FIG. a rectangular anode of the invention comprises a plur ity of strips 11 of infiltrated sintered metal (ISM) parallel, co-planar array. Usually the sintered matrix the ISM is titanium, eg., ground, compressed and s tered titanium sponge. However, the sintered mat can be made of niobium or tantalum or, for that matt any metal which will passivate under anodic conditi in the electrolyte in which the anode is being used. T iltrating metal of the ISM is advantageously lead or alloy rich in lead such as lead-tin alloys containing up about 10% by weight of tin, leadantimony alloys ıtaining up to about 15% by weight of antimony and : like. In place of lead, metals such as tin or manga- ;e which form an electrolyte-insoluble, electrocon- ctive oxide under anodic conditions can also be used infiltrants providing, of course, that the infiltrating :tal completely blocks the pores on the surfaces of the ctrode exposed to electrowinning electrolyte. Each strips 11 about 0.8 to about 3 mm thick is formed with pression or groove 12 extending the length of strip 11. ıt portion 13 of strip 11 is placed in overlapping rela- nship with depression 12 of the adjacent strip 11 and ld in place, for example, by spot welding. The cavity 'med by the overlap extending the length of strips 11 :hen filled with a metal 14 compatible with the filling :tal of the ISM. In the usual case where the ISM is .d-infiltrated sintered titanium metal, the compatible :tal is lead or an alloy rich in lead, i.e., containing :ater than about 90% lead. The stiffening members in : anode as depicted in FIG. 1 formed from compatible :tal 14 are bonded to each of the adjacent strips 11, 've to unitize these strips and also serve as a means of nnection of hanger 15 and current conductors 16. ırrent conductors 16 comprising tinned copper roads ving hangar member 15 on one end thereof are ad- ntageously fixed to strips 11 by being embedded in mpatible metal 14 eg. lead, during emplacement of mpatible metal 14 in the cavity formed by overlap of ips 11. Metal 14, in the completed anode 11 comprises :ctric current carrying rods which are metallurgically nded to and sheathed by ISM except at the exposed ds of the rods.

Figure 2:
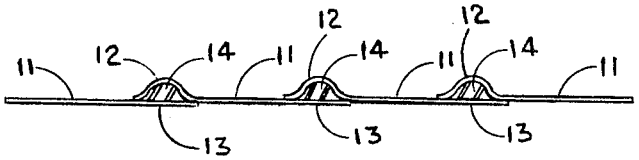
FIG. 2 is a cross-sectional view of the anode of FI 1 at section II—II.
Figure 3:
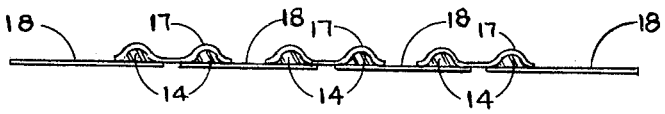
FIG. 3 is a cross-sectional view of a different anode the present invention.
Figure 4:
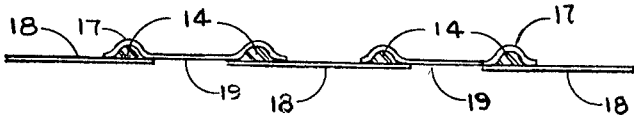
FIG. 4 is another cross-sectional view of a still diff ent anode of the present invention.
Figure 5:
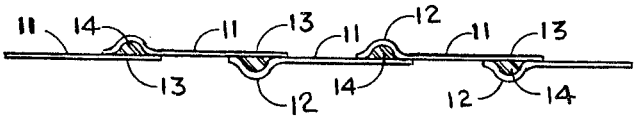
FIG. 5 is a still further cross-sectional view of other anode of the present invention.

The cross-sections of FIGS. 3, 4 and 5 of the drawing pict alternative embodiments of the anode of the esent invention. In FIG. 3 there are depicted connec- r members 17 having double depressions therein de- ;ned to bridge and hold together flat strips 18 using 'o closely spaced masses of compatible metal 14. FIG. shows a similar alternative wherein connector mem- rs 17 have a wider inner flange 19 but connect flat ips 18 in essentially the same manner as do bridging embers 17. The embodiment of FIG. 5 is essentially e same as that of FIGS. 1 and 2 except that masses of :tal 14 are on both sides of the plane of the anode in e embodiment of FIG. 5 whereas in the embodiment FIG. 1 masses of metal 14 are on one side of the plane the anode.

Those skilled in the art will appreciate that, in addi- ›n to the structures depicted in the drawing, other uivalent structures including combinations of the ıbodiments of FIGS. 1 to 5 can be employed as anodes of the present invention. Specifically included are structures having laterally extending stiffening corugations or members in addition to the longitudinally extending stiffening numbers made of compatible metal 14.

The anode structure of the present invention is particularly useful in the electrowinning of zinc, copper and like metals electrowon from sulfate electrolytes. It is believed, based upon laboratory scale tests, that the anode structure of the present invention will significantly outlast presently used argentiferous lead anode structures in the electrowinning of zinc.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. An essentially planar anode structure having surfaces of infiltrated sintered metal and a plurality of longitudinally extending ribs of a metal having an electrical conductivity greater than that of the infiltrated sintered metal and the capability of electrolytically forming an electroconductive insoluble oxide in the electrolyte in which said anode is used; said ribs being metallurgically bonded to and laterally sheathed by said infiltrated sintered metal and said ribs being bonded in conductive contact with means for feeding electrical current thereto.

2. An essentially planar anode structure comprising a plurality of strips of infiltrated sintered metal said strips being held together in planar form by at least one rod-like, longitudinally extending elongated mass of metal compatible with the metal infiltrated into said sintered metal, metallurgically bonded to and laterally sheathed by metal of at least one of said strips of infiltrated sintered metal and overlapping member made of said infiltrated sintered metal.

3. An anode structure as in claim 2 wherein said overlapping member is a part of the next adjacent strip of infiltrated sintered metal.

4. An anode structure as in claim 2 wherein said infiltrated sintered metal is lead infiltrated sintered titanium metal.

5. An anode structure as in claim 2 which also includes a hanger affixed to connecting rods, each of said connecting rods being embedded in and bonded to one of said rod-like masses of metal.

* * * * *